US008122900B1

(12) United States Patent
Hayes et al.

(10) Patent No.: US 8,122,900 B1
(45) Date of Patent: Feb. 28, 2012

(54) CANE WITH GRASPING DEVICE

(76) Inventors: Roxana Hayes, Pasadena, CA (US); Rolando Vega, Sr., Pasadena, CA (US); Rolando Vega, Jr., Pasadena, CA (US); Marlene Vega, Pasadena, CA (US)

( * ) Notice: Subject to any disclaimer, the term of this patent is extended or adjusted under 35 U.S.C. 154(b) by 0 days.

(21) Appl. No.: 13/027,417

(22) Filed: Feb. 15, 2011

(51) Int. Cl.
*A45B 3/00* (2006.01)

(52) U.S. Cl. ..... 135/66

(58) Field of Classification Search ..... 135/66; 294/100

See application file for complete search history.

(56) References Cited

U.S. PATENT DOCUMENTS

| | | | | | |
|---|---|---|---|---|---|
| 2,669,896 | A * | 2/1954 | Clough | 81/128 |
| 2,891,811 | A * | 6/1959 | Strickler | 294/50.9 |
| 3,093,402 | A * | 6/1963 | Sisson | 294/100 |
| 3,844,291 | A * | 10/1974 | Moen | 606/206 |
| 4,056,278 | A * | 11/1977 | Bau et al. | 294/1.4 |
| 4,575,143 | A * | 3/1986 | Nast | 294/65.5 |
| 4,811,750 | A | 3/1989 | McAllister | |
| 4,827,956 | A | 5/1989 | Toot | |
| 5,222,973 | A * | 6/1993 | Sharpe et al. | 606/206 |
| 5,433,234 | A | 7/1995 | Lapere | |
| 7,243,668 | B1 * | 7/2007 | Kroeze | 135/77 |
| 7,281,740 | B1 * | 10/2007 | Fields | 294/100 |
| 7,527,311 | B2 * | 5/2009 | Shih | 294/100 |
| 7,624,746 | B2 | 12/2009 | Blake | |
| 2008/0149155 | A1 | 6/2008 | Martin | |

* cited by examiner

*Primary Examiner* — Noah Chandler Hawk

(57) ABSTRACT

The cane with grasping device provides a cane that has a selectively exposed pair of spring jaws disposed downwardly within the stationary stalk of the device 10 to selectively gasp a given object. The stationary stalk of the device is disposed downwardly from the handle and is partially within the sleeve. The sliding stalk is disposed partially within the sleeve and substantially around the stationary stalk. Spring jaws are disposed downwardly on the end block that is disposed downwardly on the stationary stalk. A compression spring is disposed within the stalk and around the stationary stalk, below the handle. Elevation of the lever to a position immediately below and adjacent to the handle slides the sliding stalk upwardly and fully exposes the otherwise retreated spring jaws. Releasing the lever allows the spring jaws to automatically grasp a given object. Conversely, releasing the lever allows the jaws to release the object.

2 Claims, 3 Drawing Sheets

CANE WITH GRASPING DEVICE

BACKGROUND OF THE INVENTION

There are many reasons for an individual to have some tool for extended reach. Reasons may include a reluctance or inability to use a ladder, for example. Reasons often include physical inability to reach objects due to some form of physical challenge. Anyone who must use a cane, for example, is often quite limited in reach. Various canes exist that include apparatus for enabling a user to grasp an object that might otherwise be out of hand reach. One problem that exists, for example, is that such devices do not provide for full and hidden retreat of grasping devices. The present device uniquely solves problems associated with canes that include grasping devices.

FIELD OF THE INVENTION

The cane with grasping device relates to walking canes and more especially to a cane with an internally retreating grasping device.

SUMMARY OF THE INVENTION

The general purpose of the cane with grasping device, described subsequently in greater detail, is to provide a cane with grasping device which has many novel features that result in an improved cane with grasping device which is not anticipated, rendered obvious, suggested, or even implied by prior art, either alone or in combination thereof.

To attain this, the cane with grasping device provides a cane that has a selectively exposed pair of spring jaws disposed downwardly within the stationary stalk of the device to selectively gasp a given object. The handle is importantly disposed off-center atop the sleeve for superior cane user friendliness. The stationary stalk of the device is disposed downwardly from the handle and is partially within the sleeve. The sliding stalk is disposed partially within the sleeve and substantially around the stationary stalk. Spring jaws are disposed downwardly on the end block that is disposed downwardly on the stationary stalk. A compression spring is disposed within the stalk and around the stationary stalk, below the handle. Elevation of the lever to a position immediately below and adjacent to the handle slides the sliding stalk upwardly and fully exposes the otherwise retreated spring jaws. Releasing the lever allows the spring jaws to automatically grasp a given object. Conversely, releasing the lever allows the jaws to release the object.

The device may provide more than a pair of spring jaws. A quartet of spring jaws may be provided, for example. The automatically concealed jaws are important to the device's appearance and function.

Thus has been broadly outlined the more important features of the improved cane with grasping device so that the detailed description thereof that follows may be better understood and in order that the present contribution to the art may be better appreciated.

An object of the cane with grasping device is to provide a walking cane.

Another object of the cane with grasping device is to provide a device for extending the reach of a user.

A further object of the cane with grasping device is to provide for retraction of the extended reach mechanism.

An added object of the cane with grasping device is to provide for selective full retreat of the reach mechanism within the cane.

And, an object of the cane with grasping device is to provide substantial leverage in use of the grasping mechanism.

These together with additional objects, features and advantages of the improved cane with grasping device will be readily apparent to those of ordinary skill in the art upon reading the following detailed description of presently preferred, but nonetheless illustrative, embodiments of the improved cane with grasping device when taken in conjunction with the accompanying drawings.

DETAILED DESCRIPTION OF THE DRAWINGS

With reference now to the drawings, and in particular FIGS. 1 through 6 thereof, the principles and concepts of the cane with grasping device generally designated by the reference number 10 will be described.

Figure 1:
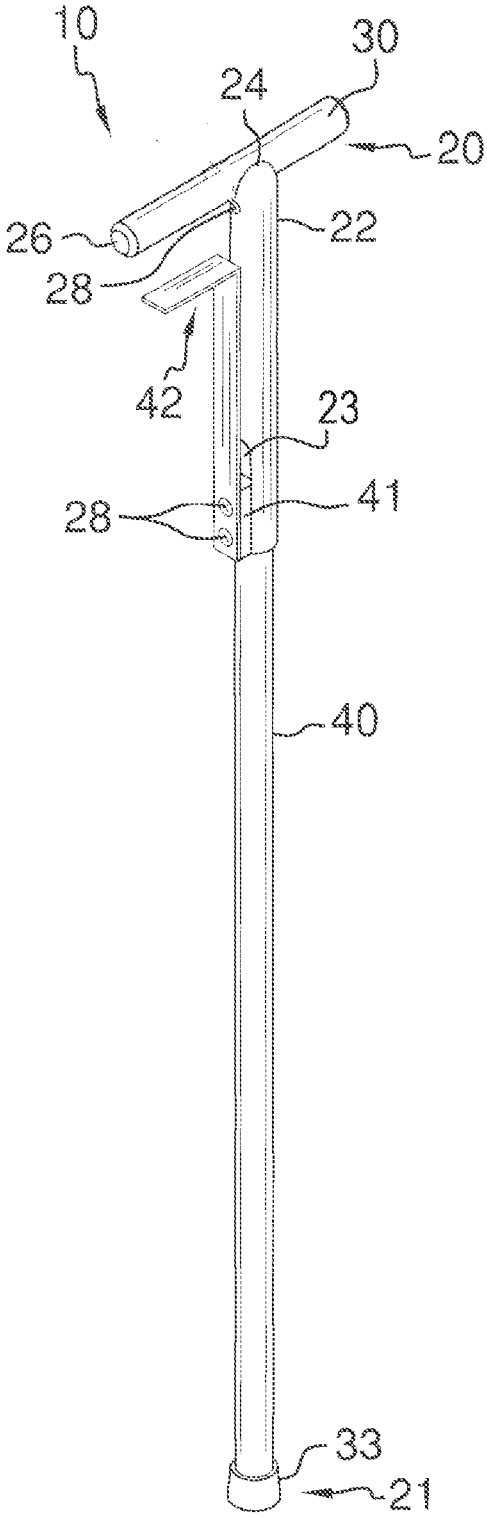
FIG. 1 is a perspective view.

Referring to FIG. 1, device 10 partially comprises a first end 20 spaced apart from a second end 21. The sleeve 22 is disposed adjacent to the first end 20. The slot 23 is disposed downwardly within the sleeve 22.

Figure 2:
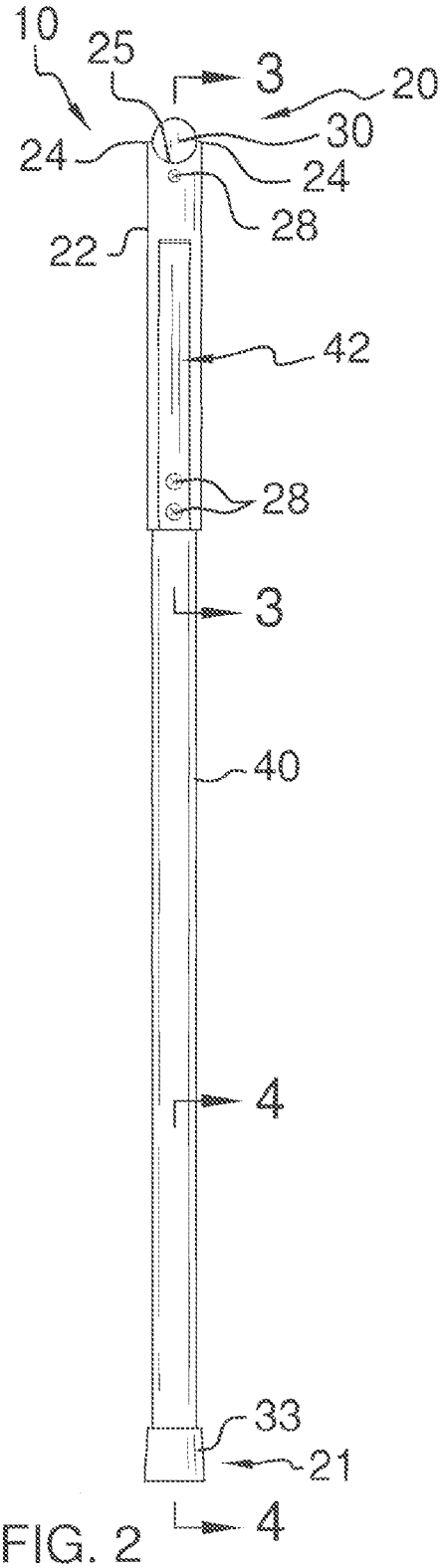
FIG. 2 is a lateral elevation view.

Referring to FIG. 2, the semicircular cavity 25 is disposed upwardly within the sleeve 22. A rounded sleeve end 24 is disposed above the semicircular cavity 25 on an each side of the sleeve 22.

Figure 3:
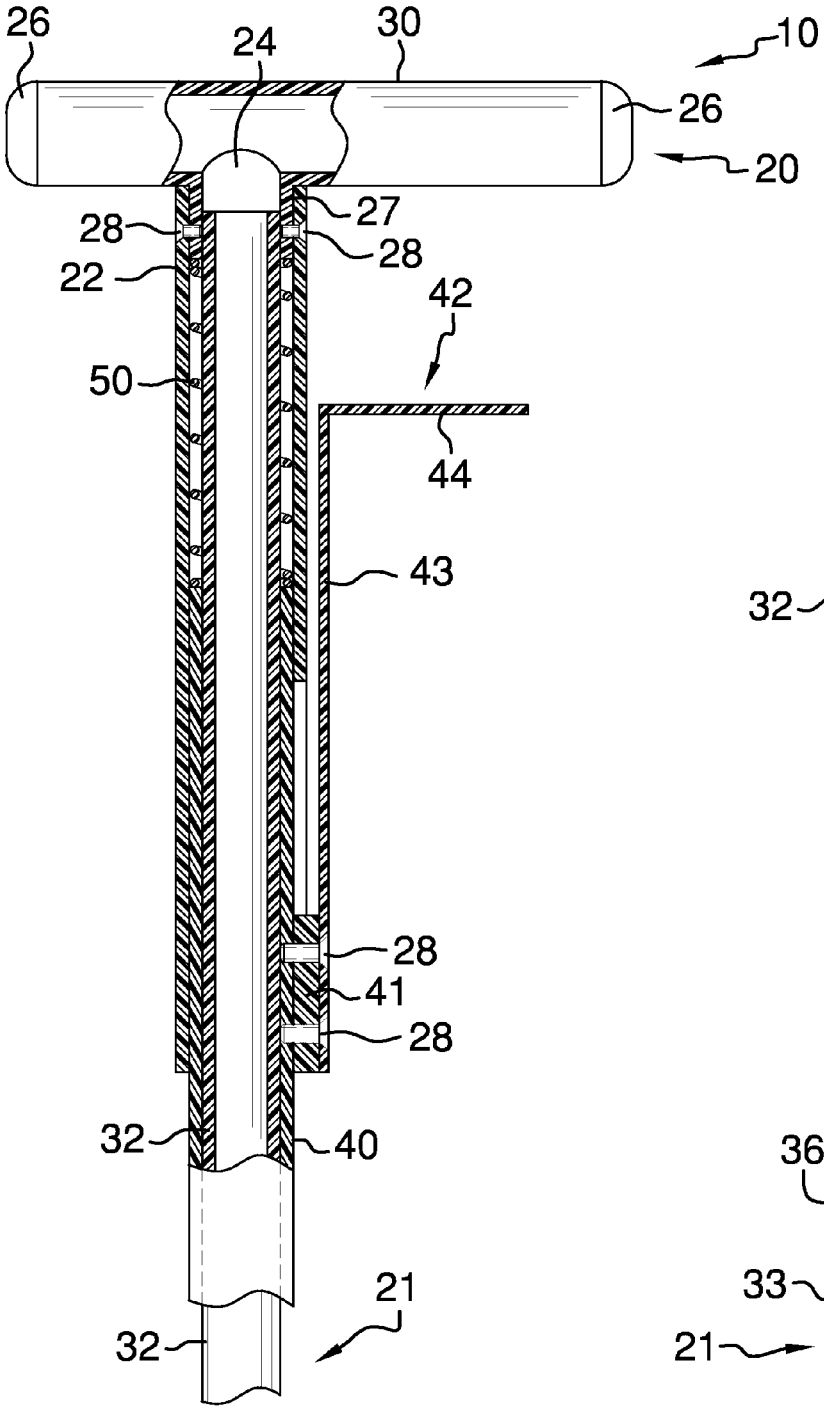
FIG. 3 is a partial cross sectional view of FIG. 2, taken along the line 3-3.

Referring to FIG. 3, the cylindrical insert 27 is disposed within the sleeve 22 below the semicircular cavity 25. The handle 30 is disposed within the semicircular cavity 25. The handle 30 is affixed off-center. The handle has a rounded handle insert 26 disposed within each handle 30 end. A plurality of spaced apart fasteners 28 affixes the sleeve 22 to the cylindrical insert 27. The stationary stalk 32 is affixed to the handle 30 and to the cylindrical insert 27. The foot 33 surrounds the sliding stalk 40 second end 21.

Figure 4:
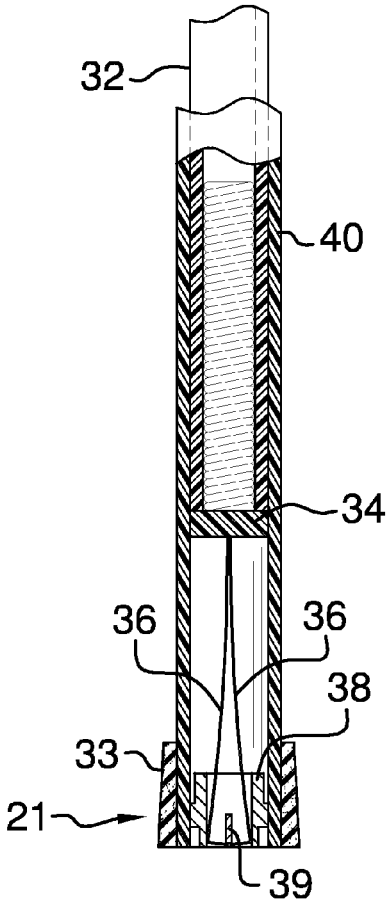
FIG. 4 is a partial cross sectional view of FIG. 2, taken along the line 4-4.

Referring again to FIG. 3 and also to FIG. 4, the stationary stalk 32 is extended to the second end 21. The end block 34 is affixed downwardly to the stationary stalk 32. The pair of mirror image spring jaws 36 is affixed downwardly to the end block 34. The spring jaws 36 have an outward preload.

Figure 6:
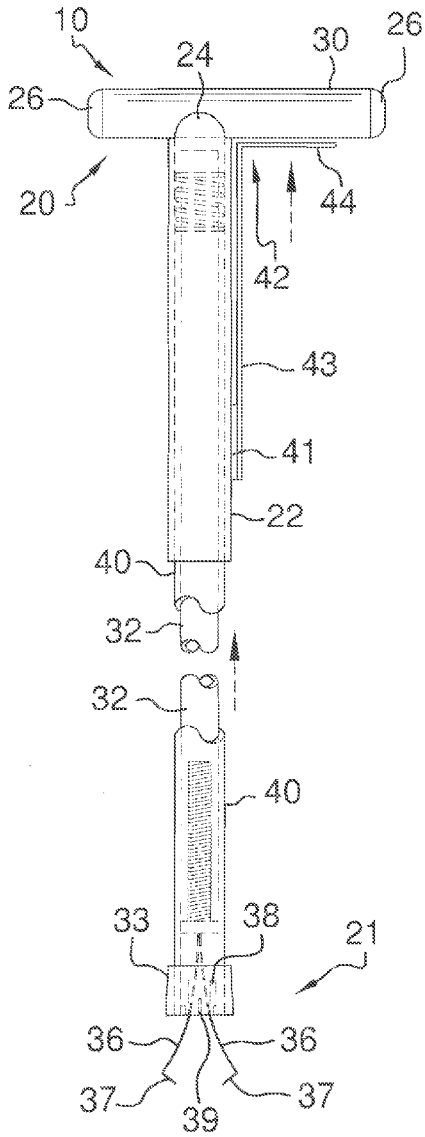
FIG. 6 is a lateral elevation view with grasping mechanism fully extended from the outer stalk.

Referring to FIG. 6, an inwardly disposed horizontal tip 37 is disposed on each spring jaw 36.

Referring to FIG. 4, the guide 38 is disposed within the sliding stalk 40 at the second end 21. The divider 39 is disposed centrally and downwardly within the guide 38 and guides the spring jaws 36 and also prevents further retreat of the horizontal tips 37 within the stationary stalk 32.

Each of the spring jaws 36 is disposed on an either side of the guide 38. The horizontal tips 37 abut the guide 38 divider 39 downwardly.

Referring again to FIGS. 3 and 4, the sliding stalk 40 is disposed slideably and outwardly on the stationary stalk 32. The sliding stalk 40 is disposed slideably and inwardly on the sleeve 22. The opening 40A is within the sliding stalk 40 second end 21.

Referring again to FIG. 3, the lever 42 has a vertical member 43 seamlessly connected upwardly to a horizontal member 44. The horizontal member 44 is disposed proximal to the handle 30. The vertical member 43 is affixed downwardly within the slot 23 to the sliding stalk 40 via the attachment block 41 with a plurality of fasteners 28. The attachment block 41 is slideably disposed within the sleeve 22 slot 23. The compression spring 50 is disposed within the sleeve 22 and around the stationary stalk 32. The compression spring 50 downwardly abuts the cylindrical insert 27 and upwardly abuts the sliding stalk 40. The compression spring 50 holds the spring jaws 36 within the sliding stalk 40 until displaced by a user.

Referring to FIG. 6, elevating the lever 42 horizontal member 44 toward the handle 30 slides the sliding stalk 40 upwardly and exposes the spring jaws 36 with horizontal tips 37. Importantly, this position sees the lever 42 immediately adjacent to the handle 30, allowing a user to easily grasp both the handle 30 and the lever 42.

Figure 5:
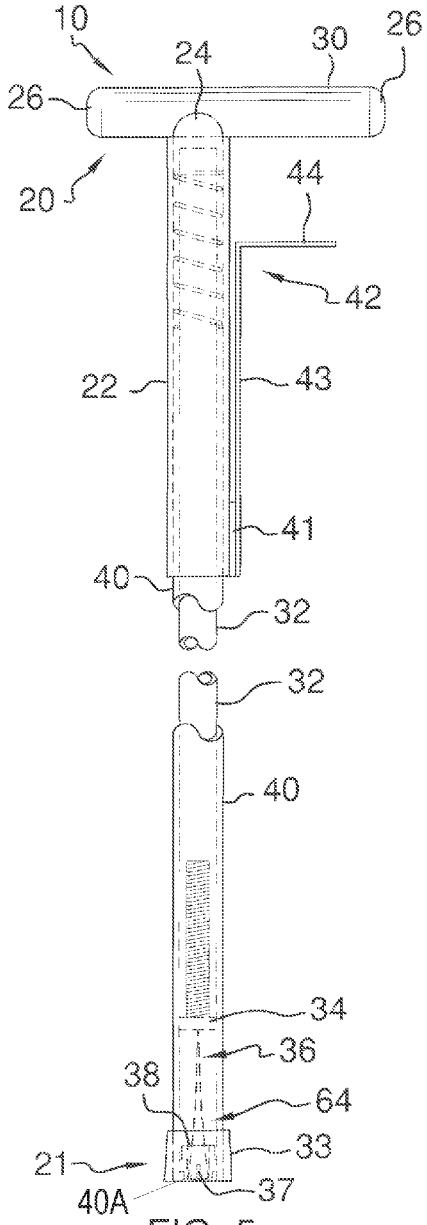
FIG. 5 is a lateral elevation view with grasping mechanism fully retreated within the outer stalk.

Referring to FIG. 5, release of the lever 42 automatically retracts the spring jaws 36 at least partially within the sliding stalk 40, thereby automatically grasping a given object until released by lever 42 elevation.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the cane with grasping device may be used.

What is claimed is:

1. A cane with grasping device comprising, in combination:

a first end spaced apart from a second end;

a sleeve disposed adjacent to the first end;

a slot disposed downwardly within the sleeve;

a handle affixed off-center and perpendicularly to the sleeve;

a cylindrical insert disposed within the sleeve and affixed to the handle;

a plurality of spaced apart fasteners affixing the sleeve to the cylindrical insert;

a stationary stalk affixed to the handle and to the cylindrical insert, the stationary stalk extended to the second end;

an end block affixed downwardly to the stationary stalk;

a pair of mirror image spring jaws affixed downwardly to the end block, the spring jaws having an outward preload;

an inwardly disposed horizontal tip on each spring jaw;

a guide disposed within the sliding stalk at the second end;

a divider disposed centrally and downwardly within the guide, each of the spring jaws disposed on an either side of the guide, the horizontal tips abutted downwardly to the guide divider;

a sliding stalk disposed slideably and outwardly on the stationary stalk, the sliding stalk disposed slideably and inwardly on the sleeve;

an opening disposed within the sliding stalk second end;

a foot surrounding the sliding stalk second end;

a lever having a vertical member seamlessly connected upwardly to a horizontal member, the horizontal member proximal to the handle, the vertical member affixed downwardly within the slot to the sliding stalk via an attachment block with a plurality of fasteners;

a compression spring disposed within the sleeve and around the stationary stalk, the compression spring downwardly abutting the cylindrical insert and upwardly abutting the sliding stalk, the compression spring holding the spring jaws within the sliding stalk;

whereby elevating the lever horizontal member toward the handle slides the sliding stalk upwardly and exposes the spring jaws with horizontal tips, a release of the lever retracting the spring jaws at least partially within the sliding stalk thereby automatically grasping a given object until released by lever elevation.

2. A cane with grasping device comprising, in combination:

a first end spaced apart from a second end;

a sleeve disposed adjacent to the first end;

a slot disposed downwardly within the sleeve;

a semicircular cavity disposed upwardly within the sleeve;

a rounded sleeve end disposed above the semicircular cavity on an each side of the sleeve;

a cylindrical insert disposed within the sleeve below the semicircular cavity;

a handle disposed within the semicircular cavity, the handle affixed off-center and perpendicularly to the sleeve and the semicircular cavity;

a plurality of spaced apart fasteners affixing the sleeve to the cylindrical insert;

a stationary stalk affixed to the handle and to the cylindrical insert, the stationary stalk extended to the second end;

an end block affixed downwardly to the stationary stalk;

a pair of mirror image spring jaws affixed downwardly to the end block, the spring jaws having an outward preload;

an inwardly disposed horizontal tip on each spring jaw;

a guide disposed within the slidinq stalk at the second end;

a divider disposed centrally and downwardly within the guide, each of the spring jaws disposed on an either side of the guide, the horizontal tips abutted downwardly to the guide divider;

a sliding stalk disposed slideably and outwardly on the stationary stalk, the sliding stalk disposed slideably and inwardly on the sleeve;

an opening disposed within the sliding stalk second end;

a foot surrounding the sliding stalk second end;

a lever having a vertical member seamlessly connected upwardly to a horizontal member, the horizontal member proximal to the handle, the vertical member affixed downwardly within the slot to the sliding stalk via an attachment block with a plurality of fasteners;

a compression spring disposed within the sleeve and around the stationary stalk, the compression spring downwardly abutting the cylindrical insert and upwardly abutting the sliding stalk, the compression spring holding the spring jaws within the sliding stalk;

whereby elevating the lever horizontal member toward the handle slides the sliding stalk upwardly and exposes the spring jaws with horizontal tips, a release of the lever retracting the spring jaws at least partially within the sliding stalk thereby automatically grasping a given object until released by lever elevation.

* * * * *